United States Patent [19]

Lin

[11] Patent Number: 4,687,239

[45] Date of Patent: Aug. 18, 1987

[54] TUBULAR DOOR LOCK WITH AN ADJUSTABLE DEVICE FOR SETTING THE DEAD BOLT

[76] Inventor: Jui C. Lin, 297, Bor Ay Road, Kaohsiung, Taiwan, 800

[21] Appl. No.: 815,934

[22] Filed: Jan. 3, 1986

[51] Int. Cl.[4] ..... E05B 9/06

[52] U.S. Cl. ..... 292/172; 70/461; 292/337; 292/DIG. 60

[58] Field of Search ..... 292/172, 337, 142, 1, 292/DIG. 60; 70/461

[56] References Cited

U.S. PATENT DOCUMENTS

| | | | |
|---|---|---|---|
| 1,661,454 | 3/1928 | Wilson | 292/337 X |
| 2,290,727 | 7/1942 | Best | 292/172 |
| 2,290,728 | 7/1942 | Best | 292/172 |
| 4,058,333 | 11/1977 | Roe et al. | 292/DIG. 60 X |
| 4,372,594 | 2/1983 | Gater | 292/DIG. 60 X |

FOREIGN PATENT DOCUMENTS

| | | | |
|---|---|---|---|
| 294220 | 1/1954 | Switzerland | 292/172 |

*Primary Examiner*—Gary L. Smith
*Assistant Examiner*—Lloyd A. Gall
*Attorney, Agent, or Firm*—Holman & Stern

[57] ABSTRACT

This invention concerns about a tubular door lock which makes use of humps attached on a cylinder for guiding and restricting the movement of a rotating shell and an extending shell enabling assembling plates hooked with the bottom of the extending shell to alter the position of the center of a fan-shaped gear on it so that the teeth of the fan-shaped gear can engage with those of the dead bolt to make up an action of pulling the dead bolt back.

2 Claims, 8 Drawing Figures

TUBULAR DOOR LOCK WITH AN ADJUSTABLE DEVICE FOR SETTING THE DEAD BOLT

BACKGROUND OF THE INVENTION

In order to fix a tubular door lock, it is necessary to cut a long opening from the side surface of a door so as to fit a dead bolt in and a circular opening through two sides of the door a suitable distance from the edge of the side surface so as to fit a knob in for moving the dead bolt. Since the size of posts used in doors are not unified, carpenters need to cut an opening at different distances according to the variety of the door. Therefore, the door lock manufacturers have to prepare more molds for making different sizes of locks and retailers have to own more space for storing them. Moreover, the consumers must as well have the knowledge about the locks should they want to buy locks of proper sizes. In order to save the above-mentioned inconveniences, the inventor has devise a tubular door lock with an adjustable device for setting the dead bolt.

DETAILED DESCRIPTION OF THE INVENTION

Figure 1:
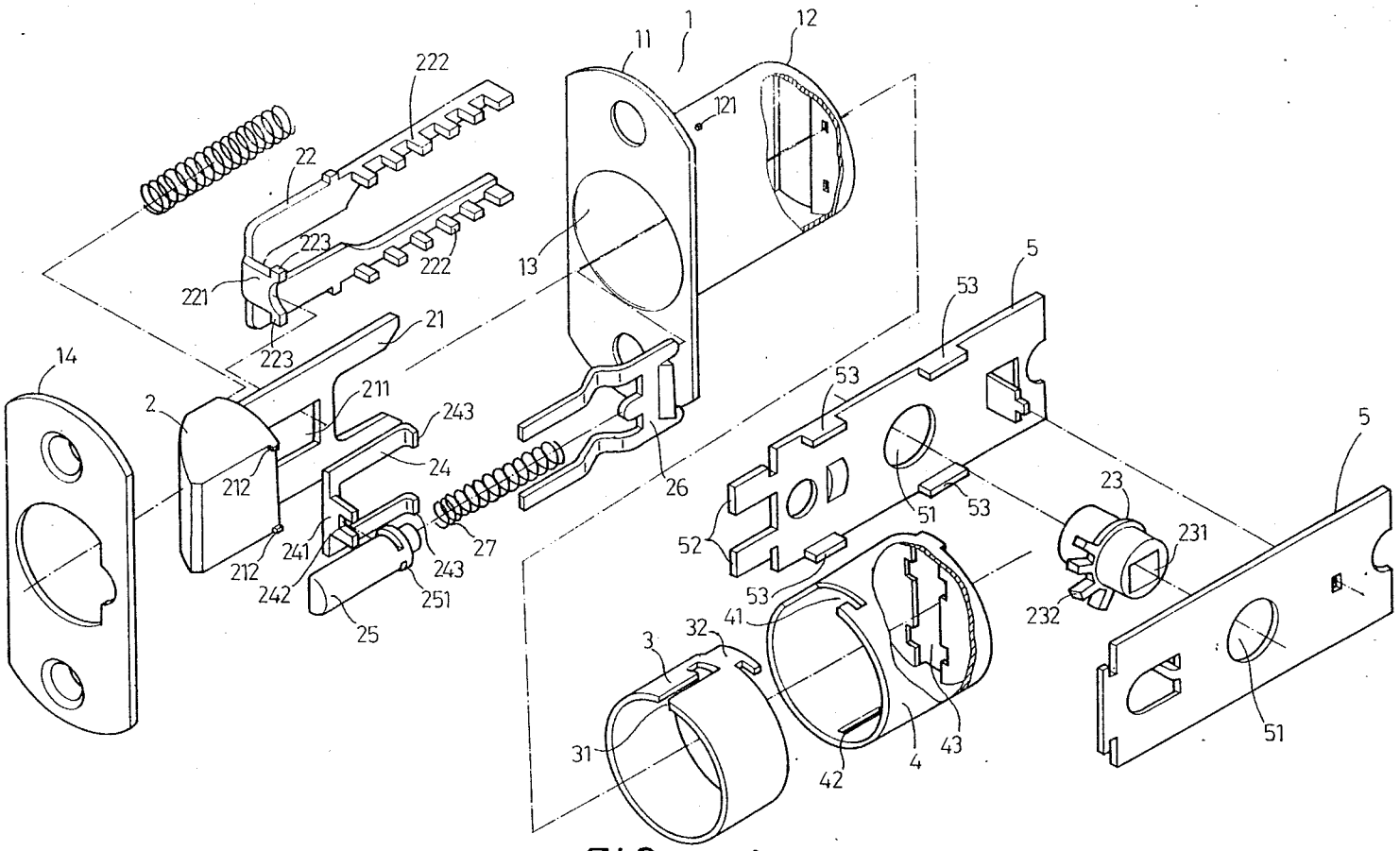
FIG. 1 is an exploded perspective view of the tubular door lock with an adjustable device for setting the dead bolt in accordance with this invention.

As shown in the FIG. 1, this invention is composed of a basic shell lock casing 1, a dead bolt 2, a rotating first adjustment cylinder shell 3, an extending shell second adjustment cylinder 4 and assembling plates 5.

The basic shell 1 comprises a face-plate 11 and a casing cylinder 12.

Cut at the center of the face-plate 11 is a circular opening 13 used for combining solidly together with the cylinder 12 which is to contain the dead bolt 2. In addition, there are two humps 121, 122 attached on the cylinder 12 as shown; the hump 121 is used to guide the rotating shell 3 and the other 122 to guide the extending shell 4.

The dead bolt 2 is to control the closing and opening of a door.

It consists of an H-shaped plate 21 which possesses a rectangular hole 211 used to combine with a pulling plate 22 so that it can be pulled by the pulling plate 22. Two fixing points 212 are fixed on the dead bolt 2 to prevent the dead bolt 2 from dropping off the basic shell 1 when the dead bolt 2 is assembled in the basic shell 1 and covered by a face-plate 14.

The pulling plate 22 comprises an up-right hook 221 for hooking with the hole 211 of the dead bolt 2. It is equipped with two racks with teeth 222 at its upper and lower sides so as to engage with a fan-shaped gear 23 for transmission. Additionally, the hook 221 has two humps 223 able to force a guarding plate 26 to move outwards as an action of opening the lock when pushed by the backward movement of the pulling plate 22.

The fan-shaped gear 23 possesses an axial hole of square shape for a shaft to be inserted and has gear teeth 232 for engaging with those of the pulling plate 22 which is to be moved by the gear teeth 232.

The unlocking plate 24 is put evenly along with the Hshaped plate 21 and is located at the back of the dead bolt 2. One of its ends is extended outwards with an arm 241 which is cut with a notch 242 so as to embrace a safety bolt 25 and the other is formed with two soles 243 so as to move the guarding plate 26 as unlocking action.

The safety bolt 25, put evenly by one side of the dead bolt 2, is cut with a groove 251 to be embraced by the unlocking plate 24. One end of a spring 27 presses against the right end of the safety bolt 25 and the other presses against the guarding plate 26.

The rotating shell 3 surrounding the cylinder, can be turned around and moved back and forth and is formed with an L-shaped slot 31 which will slide along the hump 121 on the cylinder 12 to define a bayonet connectin to confine turning or straight movement of the rotating shell. Also, there is a hook 32 in the rotating shell 3 for locking in a notch 41 in the extending shell 4 in order to restrict the movement of the extending shell 4.

The notch 41 of the extending shell 4 is to hook with the hook 32 of the rotating shell 3 and the slot 42 is to allow this shell 3 to move along the hump 122 of the cylinder in a linear motion. At the bottom of the extending shell 4, a hole 43 is cut for combining the extending shell 4 with the assembling plates 5 as a unit.

The assembling plates 5 include two plates which have a hole 51 respectively for fitting in the fan-shaped gear 23 so that it can turn at the position. In addition, after the two assembling plates 5 are riveted together, two hooking arms 52 at one of the assembling plates can combine with the hole 43 of the extending shell 4 so that the assembling plates 5 can be moved by the extending shell 4. Moreover, limiters are put on one of the assembling plates to restrict the pulling plate 22 to move in a linear motion.

Figure 2:
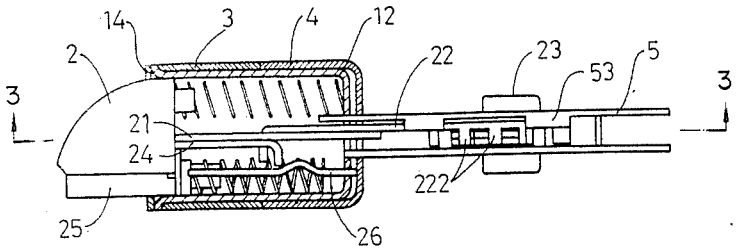
FIG. 2 is an upper cross-section view of the tubular door lock adjusted in the short size in this invention.
Figure 3:
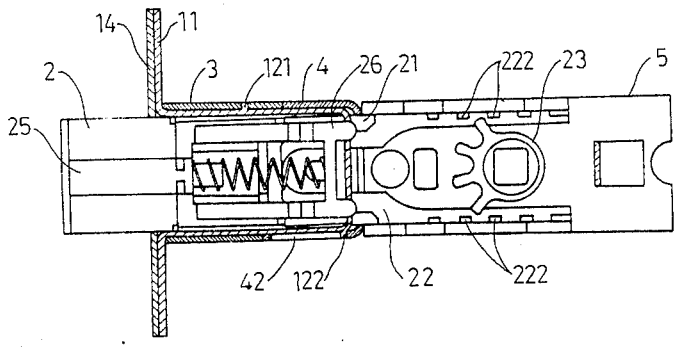
FIG. 3 is a cross-section view on line 3—3 of the FIG. 2.
Figure 4:
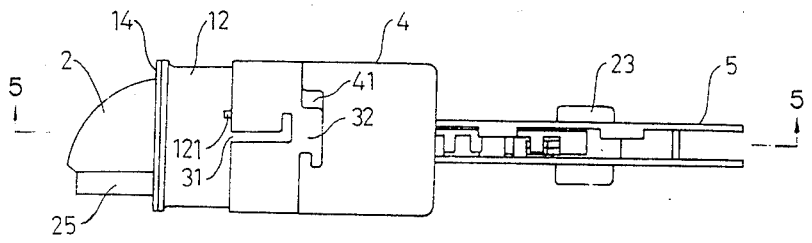
FIG. 4 is an upper cross-section view of the tubular door lock adjusted in the long size in this invention.
Figure 5:
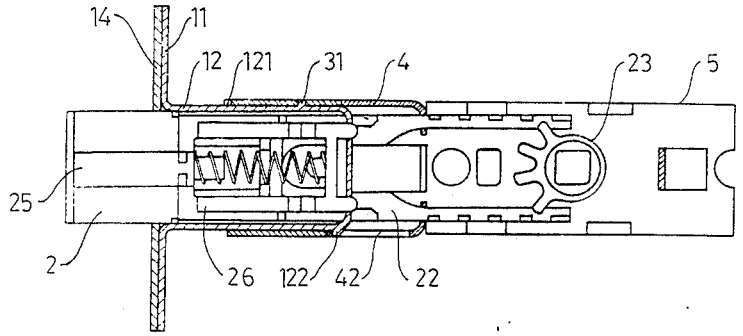
FIG. 5 is a cross-section view on line 5—5 of the FIG. 4.

How this invention operates is shown in the FIGS. 2, 3. When the knob forces the fan-shaped gear 23 to turn, the pulling plate 22 will be moved backwards and then the dead bolt 2 is to be pulled back by the pulling plate 22. Then the unlocking plate 24 pushes the guarding plate 26 which moves outwards losing the function of preventing the dead bolt 2 from moving back, and it allows an action of unlocking.

When the distance between the center of the fan-shaped gear 23 and the face-plate 14 is to be altered, the operation is needed to be explained with the FIGS. 2, 3, 4, 5 referred. For example, assume the short distance between them showed in the FIG. 2 is to be changed into the long distance between them showed in the FIG. 4. First, turn the rotating shell 3 until the latitudinal part of the L-shaped slot 31 faces just against the hump 121; by this moment, the rotating shell 3 and the extending shell 4 can be at the same time moved as far as the slot 31 leaves off the hump 121 and then to turn the rotating shell 3 so that the hump 121 may stop the exterior edge of the rotating shell 3, preventing the rotating shell 3 and the extending shell 4 from moving backwards. Then the short size has become the long size.

When the extending shell 4 is prolonged, the center position of the fan-shaped gear 23 combined with the assembling plates 5 is able to be changed accordingly, because the assembling plates 5 are also combined together with the extending shell 4. As for the pulling plate 22, it has two long racks so the fan-shaped gear 23 still engaging with the teeth 222 can move the pulling plate 22 by its turning.

Figure 6:
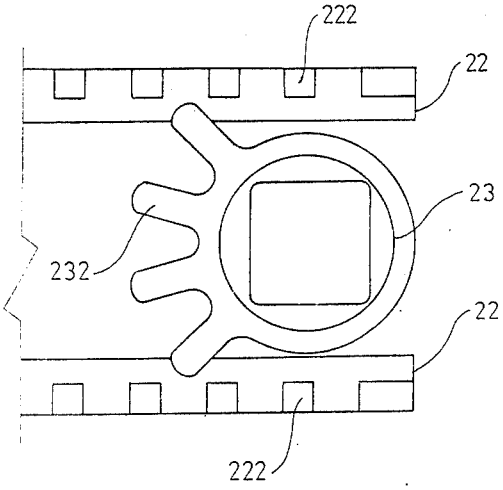
FIG. 6 is the view of the relative situation of the fan-shaped gear in motionless state with the pulling plate in this invention.
Figure 7:
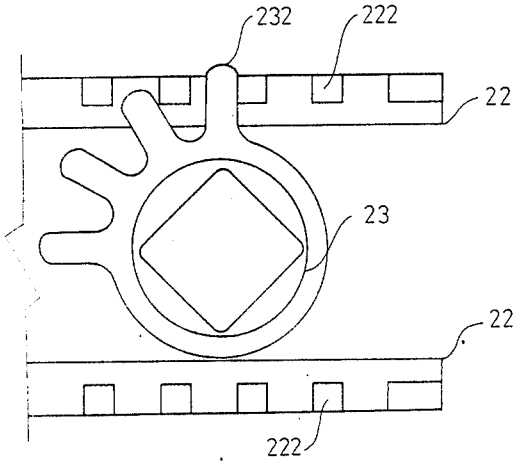
FIG. 7 is the view of the relative situation of the fan-shaped gear in motion state with the pulling plate in this invention.
Figure 8:
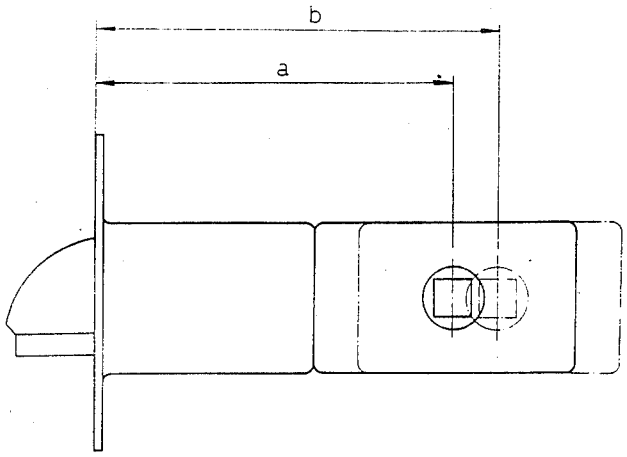
FIG. 8 is a diagram of a conventional tubular door lock.

The FIG. 6 illustrates that when the knob is not turned since a recovering spring is set in the knob, so the knob stays at its original position - the teeth 232 of the fan-shaped gear 23 do not engage with those of the pulling plate 22. Therefore, as the position of the center of the fan-shaped gear 23 is changed by the movement of the extending shell 4, the fan-shaped gear 23 can smoothly slip over the teeth 222 of the pulling plate 22. Moreover, as shown in the FIG. 7, no matter whether the fan-shaped gear 23 is rotated clockwise or counterclockwise, the teeth 232 can easily slip into the spaces between the teeth 222 engaging with the teeth 222 to move the pulling plate 22.

What is claimed is:

1. A tubular door lock comprising a lock casing having a face plate and a casing cylinder extending rearwardly from the face plate, a dead bolt with a rearwardly extending actuator plate mounted for lengthwise reciprocation in the casing cylinder, spring means connected between a back wall of the casing cylinder and the dead bolt biasing the dead bolt toward an extended position with respect to a forward end of the casing, a pulling plate extending through an opening in the back wall of the casing cylinder, the pulling plate having a hook connection with the actuator plate for retracting the dead bolt by rearward movement of the pulling plate, the pulling plate including spaced elongate rack gears extending rearwardly from the casing cylinder, an actuator assembly for moving the pulling plate comprising a segment gear journalled between a pair of assembly plates, the segment gear being located between the respective rack gears of the pulling plate, the segment gear having a rest position in which it is out of mesh with each of said rack gears whereby the segment gear can be moved lengthwise along the rack gears in the rest position, the segment gear further including a drive means for rotating same in opposite directions from the rest position to mesh with the respective rack gears thereby providing rearward movement of the pulling plate, and an adjustment means for varying the effective distance between the face plate and the segment gear, the adjustment means including adjustment cylinder means externally mounted on the casing cylinder, a bayonet connection between the casing cylinder and the adjustment cylinder means permitting selective lengthwise adjustment of the adjustment cylinder means on the casing cylinder between a retracted position and an extended position, and a mechanical connection between the adjustment cylinder means and said assembly plates whereby movement of the adjustment cylinder means between the retracted and extended positions with the segment gear in the rest position is effective to provide corresponding movement of the assembly plates and lengthwise movement of the segment gear along the rack gears.

2. The door lock as defined in claim 1 wherein the adjustment cylinder means comprises first and second adjustment cylinders, said bayonet connection being located between the first adjustment cylinder and the casing cylinder, the second adjustment cylinder being confined for axial movement on the casing cylinder, said mechanical connection being located between the second adjustment cylinder and the assembly plates, and the adjustment cylinder means including a further bayonet connection between the first and second adjustment cylinders for permitting rotational movement of the first cylinder on the casing cylinder.

* * * * *